United States Patent [19]

Rudolph

[11] Patent Number: 4,697,309

[45] Date of Patent: Oct. 6, 1987

[54] DUAL CHUTE FIBER TUFT FEEDING APPARATUS

[75] Inventor: Dieter Rudolph, Mönchengladbach, Fed. Rep. of Germany

[73] Assignee: Trützschler GmbH & Co. KG, Mönchengladbach, Fed. Rep. of Germany

[21] Appl. No.: 827,742

[22] Filed: Feb. 10, 1986

[30] Foreign Application Priority Data

Feb. 11, 1985 [DE] Fed. Rep. of Germany ..... 3504607

[51] Int. Cl.[4] ..... D01G 15/40

[52] U.S. Cl. ..... 19/105

[58] Field of Search ..... 19/105

[56] References Cited

U.S. PATENT DOCUMENTS

| | | | |
|---|---|---|---|
| 4,161,052 | 7/1979 | Erben | 19/105 X |
| 4,219,289 | 8/1980 | Trützschler | 19/105 X |
| 4,499,633 | 2/1985 | Trutzschler | 19/105 |
| 4,586,218 | 5/1986 | Pinto | 19/105 |

FOREIGN PATENT DOCUMENTS

| | | | |
|---|---|---|---|
| 0119461 | 8/1958 | U.S.S.R. | 19/105 |

*Primary Examiner*—Louis K. Rimrodt

*Attorney, Agent, or Firm*—Spencer & Frank

[57] ABSTRACT

An apparatus for feeding a fiber lap to a card, includes an upper reserve chute having an upper end through which fiber material is introduced into the apparatus, a feed roller situated at a lower end of the reserve chute and arranged for withdrawing fiber material therefrom; a feed chute having an upper end situated adjacent to the lower end of the reserve chute; and an opening roller situated in a space between the lower end of the reserve chute and the upper end of the feed chute. The opening roller is arranged under the feed roller to receive fiber material therefrom and to advance the fiber material into the feed chute through the upper end thereof. There are further provided delivery rollers at a lower end of the feed chute for withdrawing fiber material therefrom as a fiber lap; and an air circulating arrangement for introducing a compressing air stream through the upper end of the feed chute, driving the air stream through the feed chute to compress fiber material therein and withdrawing air from openings in a lower portion of the feed chute. The feed roller and the opening roller are rotated simultaneously in opposite directions relative to one another and the compressing air stream is guided adjacent the opening roller codirectionally with the rotary direction thereof.

8 Claims, 2 Drawing Figures

DUAL CHUTE FIBER TUFT FEEDING APPARATUS

BACKGROUND OF THE INVENTION

This invention relates to an apparatus for feeding a fiber lap to the input of a carding machine or a roller card unit and is of the type which has an upper or reserve chute which is charged with fiber tufts from above and a lower or feed chute which is situated underneath the reserve chute and whose lower, discharge end supplies the fiber lap formed from the fiber tufts in the feed chute. For this purpose, the fiber tufts are compressed in the feed chute with the aid of a circulating air stream which enters at the top of the feed chute and exits the same through air outlet openings at its lower end. Between the outlet of the reserve chute and the inlet of the feed chute there is arranged an opening roller which forwards the tufts from the reserve chute to the feed chute. The fiber tuft is supplied to the opening roller by a feed roller which is situated at the lower end of the reserve chute.

According to prior art constructions, the direction of rotation of the feed roller and the opening roller are unidirectional with respect to one another. The fiber entering the gap defined between the feed roller and a stationary feed baffle is caused to change direction from the direction of rotation of the feed roller to the direction of rotation of the opening roller. This circumstance disadvantageously results in a fiber beard of significant length, whereby fiber tufts of relatively large dimensions are formed.

SUMMARY OF THE INVENTION

It is an object of the invention to provide an improved apparatus of the above-outlined type from which the discussed disadvantage is eliminated and in which the feed of the fiber material to the opening roller and the opening of the fiber material are amerliorated.

This object and others to become apparent as the specification progresses, are accomplished by the invention, according to which, briefly stated, the feed roller and the opening roller situated between the reserve chute and the feed chute rotate in opposite directions.

By virtue of the above-stated measure the feed roller and the opening roller move codirectionally in the zone in which they cooperate with one another, that is, the opening operation performed by the opening roller is effected in the same direction as the feed of the fiber material by the feed roller to the opening roller. This results in a gentle transfer of the fiber material from the feed roller to the opening roller and thus the fiber beard delivered to the opening roller by the feed roller is relatively short, advantageously resulting in smaller fiber tufts.

According to a further feature of the invention, the edge of the feed baffle is oriented in the direction of rotation of the opening roller. Further, the connecting line between the axis of the feed roller and that of the opening roller is oriented to the vertical at an angle other than zero. In certain instances advantageously the angle is 90°, that is, the feed roller and the opening roller are situated horizontally side-by-side.

According to a further feature of the invention, the feed roller has a sawtooth clothing to improve the combing of the material. Expediently, the opening roller also carries a sawtooth clothing to effect a finer fiber opening.

According to a further feature of the invention, the air stream performing a compressing function in the feed chute is introduced into the latter between the feed roller and the upper zone of the feed chute. Expediently, the compressing air stream is oriented in the rotary direction of the opening roller so that the air entrained by the opening roller and the compressing air stream flow codirectionally.

DESCRIPTION OF THE PREFERRED EMBODIMENTS

Figure 1:
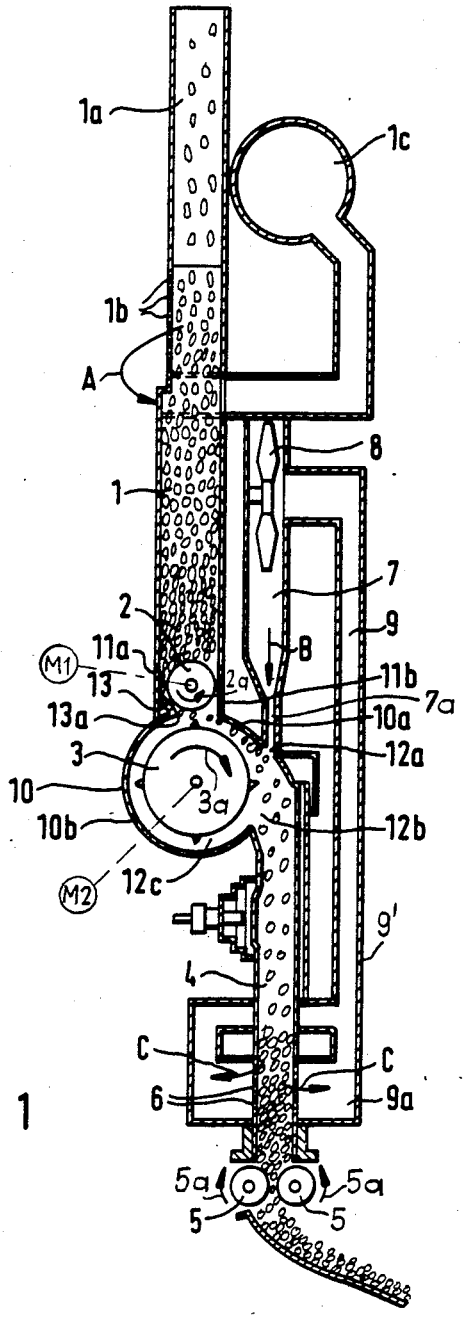
FIG. 1 is a schematic sectional side elevational view of a preferred embodiment of the invention.

Turning to FIG. 1, the tuft feeding apparatus shown therein is, as a rule, installed adjacent a carding machine, at the input side thereof. The apparatus includes a vertical reserve chute 1 which is charged at the top with finely opened fiber material. Such charging may be effected, for example, by a condenser in a supply and distributor conduit 1*a*. In the upper zone of the reserve chute 1 there are provided air outlet openings 1*b* through which the fiber tuft conveying air leaves the reserve chute 1 after the separation of the fiber tufts and is introduced into a suction device 1*c* as indicated by the arrow A.

The lower outlet area of the reserve chute 1 is largely occupied by a feed roller 2 which cooperates with a feed baffle 13 attached to the inside of the reserve chute 1. The feed roller 2 advances the fiber tuft from the reserve chute 1 and through the gap which it defines with the feed baffle 13, to an opening roller 3 which is situated below the feed roller 2 and which is provided with pins or sawtooth wire. One part of the peripheral surface of the opening roller 3 is oriented towards and is in direct communication with the inlet of a vertically oriented feed chute 4. The opening roller 3 which rotates in the direction of the arrow 3*a* advances the fiber material, which it entrains from the feed roller 2, into the feed chute 4. The feed chute 4 has, at its lower end, two delivery rollers 5 which rotate in opposite directions as shown by the arrows 5*a* and which withdraw the fiber material from the feed chute 4 and advance the material (fiber lap) to a card (not shown). The above-described construction generally corresponds to that of an "EXACTAFEED FBK" model, manufactured by Trützschler GmbH & Co. KG, Mönchengladbach, Federal Republic of Germany.

According to the invention, the feed roller 2 rotates in the direction of the arrow 2*a*, thus, oppositely to the direction of rotation 3*a* of the opening roller 3. In the illustrated example, the feed roller 2 rotates counterclockwise whereas the opening roller 3 rotates clockwise. The feed roller 2 and the opening roller 3 may be driven by separate motors M1 and M2.

The walls of the feed chute 4, at the lower portion thereof, are provided with air outlet openings 6 which extend up to a certain height of the feed chute 4. The feed chute 4 communicates at its upper entrance opening with a space 7, at the upper end of which there is arranged a fan 8. The space 7 is defined by an air duct 7'. The rotating feed roller 2 and opening roller 3 continuously deliver, at a certain flow rate, fiber material into the feed chute 4 and an equal quantity of processed fiber material is withdrawn from the bottom of the feed chute 4 by the delivery rollers 5 and advanced to the carding machine. In order to uniformly densify the fiber material and to maintain the discharged fiber quantities in the fiber lap constant, the fan 8 drives air downwardly in the space 7 through a construction 7*a* of, for example, 8 mm wide. The air stream is directed into the feed chute 4 to impinge on and pass through the fiber tuft column accumulating therein. Thus, the fan 8 draws air from an air channel 9, defined by an air duct 9' and forces the air through the fiber tuft column situated in the feed chute 4. Thereafter, the air exits the feed chute 4 through the air outlet openings 6 at the lower end of the feed chute 4 as indicated by the arrows C. The air outlet openings 6 directly communicate with a lower terminus 9*a* of the air channel 9 whose upper end terminates immediately at the suction (intake) side of the fan 8.

The opening roller 3 is surrounded by a housing 10 formed essentially of two arcuate housing portions 10*a* and 10*b*, whereas the feed roller 2 is surrounded by a housing 11 formed of housing parts 11*a* and 11*b*. The housing parts 10*a* and 10*b* conform to the periphery of the opening roller 3, whereas the wall portions 11*a* and 11*b* conform to the periphery of the feed roller 2. The housing 10 forms, between the inner wall zone 10*a* and the opening roller 3 a fiber guiding channel 12*a* for the fiber tufts. As viewed in the direction of rotation of the opening roller 3, the housing 10 is, at its junction with the wall zone 10*a*, interrupted by an opening 12*b* for the fiber material providing an outlet for the fiber material to the feed chute 4. The wall portion 10*b* adjoins the opening 12*b* and bounds an annular channel 12*c* which extends partially around the opening roller 3 to the feed roller 2. At the wall portion 11*a* situated adjacent the lower end of the feed roller 2 there is arranged a feed baffle 13 whose edge 13*a* is oriented in the direction of rotation of the opening roller 3. The compressing air stream whose direction is indicated by the arrow B is introduced between the feed roller 2 and the upper zone of the feed chute 4, whereby the flow direction B of the compressing air stream is codirectional with the direction of rotation of the opening roller 3.

Figure 2:
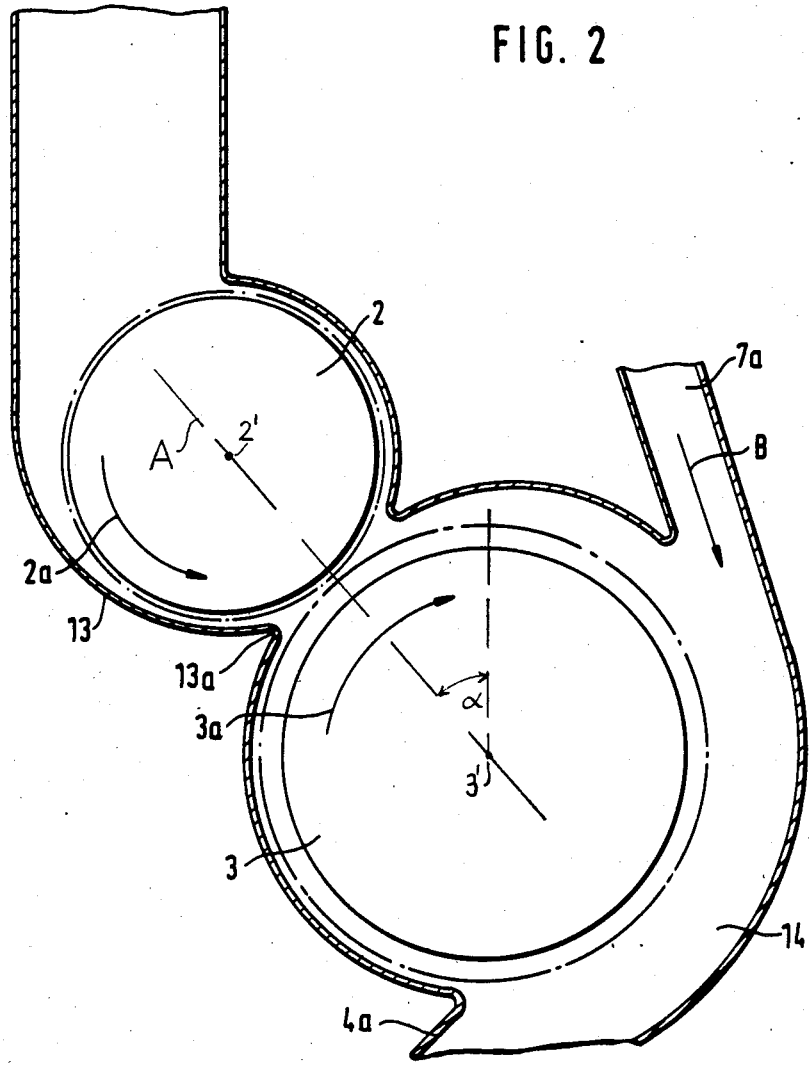
FIG. 2 is a schematic sectional side elevational view of another preferred embodiment of the invention, drawn on an enlarged scale relative to FIG. 1.

Turning now to FIG. 2, the feed roller 2 and the opening roller 3 are arranged at an oblique orientation with respect to one another, that is, an imaginary line A connecting the rotary axes 2', 3' of the feed roller 2 and the opening roller 3, respectively, forms an angle $\alpha$ other than zero with the vertical. The direction B of the compressing air current which is introduced into the feed chute between the feed roller 2 and the upper zone 4*a* of the feed chute coincides with the direction of rotation 3*a* of the opening roller 3. Between the air inlet (constriction) 7*a* which is oriented approximately tangentially to the opening roller 3 and the upper zone 4*a* there is provided an arcuate channel 14 for the compressing air flow B. The opening roller 3 advances the fiber tufts into the air stream in the air channel 14. The latter is oriented generally downwardly and is bounded by a substantial part of the cylindrical peripheral surface of the opening roller 3, whereby a removal of the fiber tufts from the clothing of the opening roller 3 is aided by the compressing air stream B. The air channel 14 is bounded externally by a housing portion 10*c* which generally conforms to the curvature of the opening roller 3.

The outer circumference of the clothing provided on the feed roller 2 and the opening roller 3 are designated with a circle drawn in dash-dot lines.

It will be understood that the above description of the present invention is susceptible to various modifications, changes and adaptations, and the same are intended to be comprehended within the meaning and range of equivalents of the appended claims.

I claim:

1. In an apparatus for feeding a fiber lap to a card, including an upper reserve chute having an upper end through which fiber material is introduced into the apparatus, a feed roller situated at a lower end of said reserve chute and arranged for withdrawing fiber material from said reserve chute; a feed chute having an upper end situated adjacent to the lower end of said reserve chute; an opening roller situated in a space between the lower end of the reserve chute and the upper end of the feed chute; said opening roller being arranged under the feed roller to receive fiber material therefrom and to advance the fiber material into said feed chute through the upper end thereof; delivery rollers arranged at a lower end of said feed chute for withdrawing fiber material therefrom as a fiber lap; and air circulating means for introducing a compressing air stream through the upper end of said feed chute, driving the air stream through said feed chute to compress fiber material therein and withdrawing air from openings in a lower portion of said feed chute, the improvement comprising means for rotating said feed roller and said opening roller simultaneously in opposite directions relative to one another; and means, forming part of said air circulating means, for guiding the compressing air stream adjacent said opening roller codirectionally with the rotary direction thereof.

2. An apparatus as defined in claim 1, further comprising a stationary feed baffle cooperating with said feed roller to define a gap therewith; said baffle having a terminal edge oriented in the direction of rotation of said opening roller.

3. An apparatus as defined in claim 1, wherein said feed roller and said opening roller have parallel-spaced rotary axes; and wherein an imaginary line connecting said axes and being perpendicular thereto forms with the vertical an angle other than zero.

4. An apparatus as defined in claim 3, wherein said angle is 90°.

5. An apparatus as defined in claim 1, wherein said feed roller has a sawtooth clothing.

6. An apparatus as defined in claim 1, wherein said opening roller has a sawtooth clothing.

7. An apparatus as defined in claim 1, wherein said air circulating means comprises means for introducing the compressing air stream into a zone adjoining said opening roller and being situated between said upper end of said feed chute and the lower end of said feed roller.

8. A method for feeding a fiber lap to a card with an apparatus including an upper reserve chute having an upper end through which fiber material is introduced into the apparatus, a feed roller situated at a lower end of said reserve chute and arranged for withdrawing fiber material from said reserve chute; a feed chute having an upper end situated adjacent to the lower end of said reserve chute; an opening roller situated in a space between the lower end of the reserve chute and the upper end of the feed chute; said opening roller being arranged under the feed roller to receive fiber material therefrom and to advance the fiber material into said feed chute through the upper end thereof; delivery rollers arranged at a lower end of said feed chute for withdrawing fiber material therefrom as a fiber lap; and air circulating means for introducing an air stream through the upper end of said feed chute, driving the air stream through said feed chute to compress fiber material therein and withdrawing air from openings in a lower portion of said feed chute, comprising the step of rotating said feed roller and said opening roller simultaneously in opposite directions relative to one another and guiding the compressing air stream adjacent said opening roller codirectionally with the rotary direction thereof.

* * * * *